US006352099B1

(12) United States Patent
Koya et al.

(10) Patent No.: US 6,352,099 B1
(45) Date of Patent: Mar. 5, 2002

(54) ALUMINUM ALLOY DIE CASTING METHOD

(75) Inventors: Eitarou Koya; Masahiko Nakagawa, both of Wako; Gumpachi Fujimoto, Kumamoto-ken; Mitsunori Murakami, Kumamoto-ken; Atsushi Kawauchi, Kumamoto-ken, all of (JP)

(73) Assignees: Honda Giken Kogyo Kabushiki Kaisha, Tokyo; Kyushu Yanagawa Seiki Co., Ltd., Kumamoto-ken, both of (JP)

( * ) Notice: Subject to any disclaimer, the term of this patent is extended or adjusted under 35 U.S.C. 154(b) by 0 days.

(21) Appl. No.: 09/368,369

(22) Filed: Aug. 4, 1999

(30) Foreign Application Priority Data

Aug. 10, 1998 (JP) ..... 10-226365

(51) Int. Cl.[7] ..... B22C 3/00; B22D 17/10
(52) U.S. Cl. ..... 164/72; 164/113
(58) Field of Search ..... 164/113, 72, 312, 164/267

(56) References Cited

U.S. PATENT DOCUMENTS 3,963,502 A * 6/1976 Borbely et al. ..... 164/72
5,263,531 A * 11/1993 Drury et al. ..... 164/113
5,579,825 A * 12/1996 Shibata et al. ..... 164/113

FOREIGN PATENT DOCUMENTS

JP 4-172166 6/1992

* cited by examiner

*Primary Examiner*—Kuang Y. Lin
(74) *Attorney, Agent, or Firm*—Merchant & Gould P.C.

(57) ABSTRACT

An aluminum alloy die casting method comprising the steps of providing a die casting machine having a gate for allowing passage of molten aluminum alloy, setting a flow rate of the molten aluminum alloy at the gate to be in a range of 5 m/sec to 15 m/sec, and press-injecting the molten aluminum alloy into a cavity of a die. With this arrangement, it becomes possible to obtain a weldable casting with no entrapment of air. An aluminum alloy for a vehicular part, which is formed of a die cast product manufactured by the die casting method of the present invention, is weldable and also dense in structure. As a result, these vehicular parts formed of the die-cast products are manufactured on a large scale at a low cost.

3 Claims, 6 Drawing Sheets

ALUMINUM ALLOY DIE CASTING METHOD

BACKGROUND OF THE INVENTION

1. Field of the Invention

The present invention relates to an aluminum alloy die casting method which allows for the manufacture of a weldable casting.

2. Description of the Related Art

Casting a molten aluminum alloy in a die in atmospheric air using only gravity as a force is called a "gravity die casting method" or simply a "die casting method". Such a casting method has been effectively used to manufacture aluminum alloy castings for use as parts of a two-wheeled or lightweight vehicle body, or for engine parts.

However, the gravity die casting has problems, as in a sand mold casting method, such that its long cycle of casting limits productivity, the produced castings have poor dimensional accuracy, and a post heat-treatment is required to improve the strength of the castings.

In an attempt to solve these problems, it became necessary to consider adopting a die casting method which provides improved dimensional accuracy and has an extremely short cycle of casting. The principle of this die casting method resides in press-injecting molten metal into a cavity of a die at a high speed and pressure. In this die casting method, since molten metal is injected at a high speed, air is entrapped in the molten metal and remains as bubbles in a casting, with the result that the bubbles produce blisters on the surface of the casting upon heating of the latter. On the other hand, this die casting method is advantageous in that since molten metal is injected at a high pressure, a die-cast product obtained by the method has a dense structure and a flat cast surface, which lead to increased strength of the product and thus eliminate the necessity for giving a post heat-treatment to the product.

For manufacturing a three-dimensional structure such as a two-wheeled vehicle body, it becomes necessary to weld castings together. A casting obtained by the above-described gravity die casting is weldable but not a casting obtained by the latter die casting method.

Various improved die casting methods have been proposed for the manufacture of weldable die-cast products. An example is Japanese Patent Laid-Open Publication No. HEI-4-172166 entitled "METHOD OF MANUFACTURING ALUMINUM CAST PARTS FOR BRAZING". According to this method, as shown in the drawing figures of the publication, a flow rate of molten metal at a gate (gate velocity) is switched stepwise between a low flow rate ranging from 0.3 m/sec to 0.6 m/sec for a first half of processing and a high flow rate ranging from 10 m/sec to 30 m/sec for a latter half of the processing.

However, in an associated die casting machine, an expensive control mechanism and a highly advanced control technique are required to switch the moving speed of a piston in the course of forward movement thereof. Further, the die casting machine is required to have increased rigidity so that it can withstand a large accelerating or decelerating force generated due to the change in moving speed of the piston. There has also been known a die casting machine having two cylinders that can be selectively used for effecting the change in moving speed of a piston. Although such a die casting machine facilitates the control of the movement speed of the piston to some extent, it becomes large in size.

SUMMARY OF THE INVENTION

It is therefore an object of the present invention to provide an aluminum alloy die casting method which enables the manufacture of a weldable die-cast product without requiring expensive modifications to an existing die casting machine and a highly advanced control technique.

To achieve the above object, according to the present invention, there is provided an aluminum alloy die casting method comprising the steps of providing a die casting machine having a gate for allowing passage of molten aluminum alloy, setting a flow rate of the molten aluminum alloy at the gate to be in a range of 5 m/sec to 15 m/sec, and press-injecting the molten aluminum alloy into a cavity of a die.

With this arrangement, it becomes possible to obtain a weldable casting with no entrapment of air. For example, an aluminum alloy for a vehicular part, which is formed of a die cast product manufactured by the die casting method of the present invention, is weldable and also dense in structure. As a result, these vehicular parts formed of the die-cast products are manufactured on a large scale at a low cost.

As will be described in detail with reference to FIG. 2, the amount of gas entrapped in a casting gradually increases with the increase in the flow rate of molten metal passing through the gate. It significantly increases particularly when the flow rate exceeds 15 m/sec. Also, as will be described in detail with reference to FIG. 3, the yield strength of the casting is maximized when the flow rate of molten metal passing through the gate is in a range of 7 m/sec to 9 m/sec. The yield strength becomes small when the flow rate is reduced to 5 m/sec, although the amount of gas entrapped in the casting is small at such a flow rate, 5 m/sec. This is believably because molten metal gets cooled and loses some of its fluidity during filling into a mold cavity at a flow rate less than 5 m/sec, thereby causing incomplete filling. In other words, at a flow rate less than 5 m/sec, the die casting cannot fully perform its operation of molten metal filling at a high speed and pressure. In aluminum alloy die casting, it is thus necessary to keep the flow rate at a pouring gate in a range of 5 m/sec to 15 m/sec.

It may be readily appreciated by a skilled artisan that the shape and size of a casting reflects upon the die casting. For example, a time required to fill up a mold cavity becomes larger with the increase in size of a casting. When producing a large-sized casting, there may occur an inconvenience such that an initially injected part of molten metal is solidified before the cavity is completely filled up, or a portion having a thin thickness is solidified in a far shorter time compared to other portions of the casting.

Although the inventive molten metal flow rate at the pouring gate is determined irrespective of the shape and size of a casting, it would be more practical if the shape and size of the casting are taken into consideration.

To this end, by using F. C. Bennett's equation which is based on the thought that filling should be completed within a time of 70% of the time required for complete solidification of molten metal, the present inventors have decided to establish a simplified equation for determining a sectional area of the gate with the flow rate of molten metal passing through the gate, the specific heat of molten metal, the temperature of molten metal, the thickness of a casting, and the like taken into consideration.

The following equation (1) is given by multiplying F. C. Bennett's equation by a modification factor a. A relationship of $t=0.808T^2$ is obtained by substituting numerical values in variables of the equation, for example, 0.23 and 650 into "c" and "Tm", respectively.

The density (2.35 g/cm$^3$) of molten metal becomes smaller than the density (2.7 g/cm$^3$) of the metal in solid state at room temperature due to thermal expansion of the metal.

$$t = \alpha \cdot \frac{c(Tm - Ts) + Ga}{4\lambda(Tm - Td)} \cdot \rho \cdot T^2 \quad (1)$$

where t (filling time): (sec)

α (modification factor): 1.5 c (specific heat of molten metal): 0.23 (cal/g·° C.)

Tm (temperature of molten metal): 650 (° C.)

Ts (temperature of solid line): 598 (° C.)

Td (surface temperature of die): 300 (° C.)

Ga (latent heat of molten metal): 94 (cal/g)

ρ (density of molten metal): 2.35 (g/cm$^3$)

λ (heat conductivity): 0.33 (cal/cm·s·° C.)

T (thickness of casting): (cm)

The following equation (2) (W=γ·100vn·t·S) is obtained for a casting having a weight W which is manufactured by filling a cavity with molten metal through a gate having a sectional area S at a flow rate v1 or v2 of the molten metal passing through the gate for a filling time t. Numeral 100 on the right side of the equation is a value for converting the unit "m" (meter) into the unit "cm" (centimeter).

$$W = \gamma \cdot 100vn \cdot t \cdot S \quad (2)$$

where

W (weight of casting): (g)

γ (specific gravity of casting): 2.7 (g/cm$^3$)

vn:

v1 (flow rate at gate): 5 (m/sec)

v2 (flow rate at gate): 15 (m/sec)

t (filling time): 0.808T$^2$ (sec)

From the above equation (2), the sectional area S is given by the following equation (3). In addition, the equation (4) below is given by substituting numerical values in variables of the equation (3), for example, 2.7, 5, and 15 in γ, v1 and v2, respectively.

$$\frac{W}{\gamma \cdot 100v2 \cdot 0.808T^2} \le S \le \frac{W}{\gamma \cdot 100v1 \cdot 0.808T^2} \quad (3)$$

$$\frac{W}{3272.4 \times T^2} \le S \le \frac{W}{1090.8 \times T^2} \quad (4)$$

It is thus preferred that the present invention further includes the step of setting the sectional area S (cm$^2$) of the gate to be in a range obtained by the above equation (4), where W (g) is the weight of a casting and T (cm) is a typical thickness of the casting.

The simplified equation (4) is provided to determine the sectional area of the gate with the flow rate of molten metal passing through the gate, the specific heat of molten metal, the temperature of molten metal, the thickness of a casting, and the like taken into consideration. In the equation (4), the term on the left side is the sectional area of the gate obtained when the flow rate of molten metal passing through the gate is 5 m/sec, whilst the term on the right side is the sectional area of the gate obtained when the flow rate of molten metal passing through the gate is 15 m/sec. By virtue of the equation (4), the sectional area of the gate can be simply determined without complicated calculation, thereby making it possible to reduce the number of design steps for machine installation and adjustment steps during test run.

Desirably, the method according to the present invention further includes the step of coating the die with a mold releasing agent which contains an inorganic component and graphite as main components and a volatile component of less than 30 wt % as a sub-component but does not contain moisture.

Use of a mold releasing agent is effective to smoothly release a casting from a die. The mold releasing agent is required to contain a volatile component such as a high polymer synthetic oil. The volatile component makes the mold releasing agent, which has high stickiness, to remain stuck on the mold. The volatile component is, however, thermally decomposed to produce a hydrogen gas. When the content of the volatile component is more than 30 wt %, a large amount of gas is produced to exert an adverse effect on weldability of the casting. When it is less than 15 wt %, the stickiness of the mold releasing agent is insufficient. Accordingly, in the inventive aluminum alloy die casting method, the content of the volatile component, which volatilizes at a temperature of 700° C. or more, should fall in a range of 30 wt % or less, preferably in a range of 15 to 30 wt %.

The die casting method according to the present invention may further include the step of arranging the gate to be positioned at that portion of the casting which is used for weld connection to other structural parts. A casting defect is less induced at the gate portion of the casting, as compared with other portions of the casting. Accordingly, a desirable welded structure with less welding defect is obtained by welding at the gate portion of the casting to other structural parts.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

The following description is merely exemplary in nature and is in no way intended to limit the invention or its application or uses.

Figure 1:
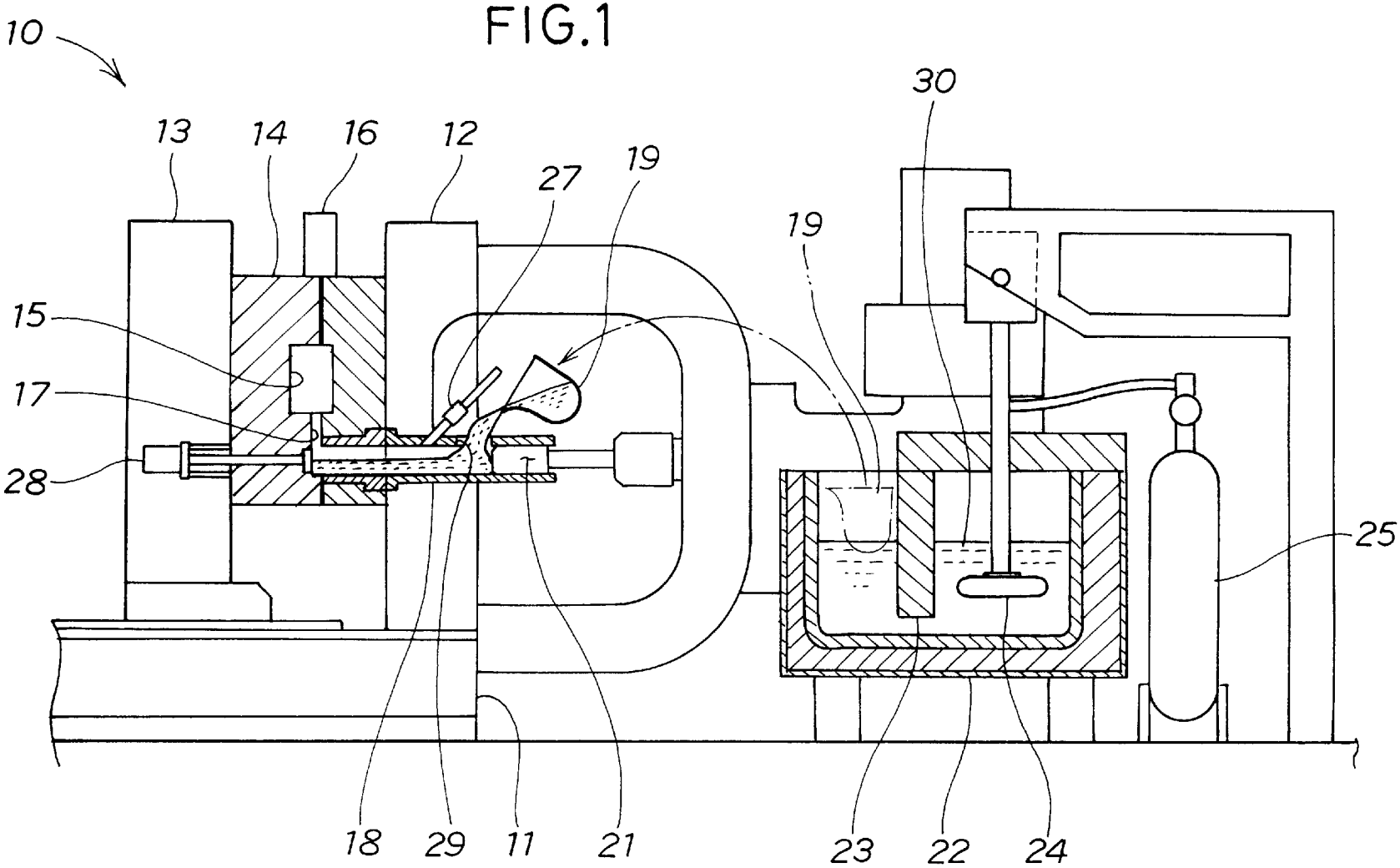
FIG. 1 is a schematic view showing a die casting facility incorporating the principle of the present invention.

Referring to FIG. 1, generally designated by reference numeral 10 is a die casting facility incorporating the principle of the present invention. The die casting facility 10 comprises a die 14 held by a fixed or stationary platen 12 and a moving platen 13 rising from a base 11, a vacuum apparatus 16 for evacuating a cavity 15 in the die 14, a sleeve 18 disposed to confront a gate 17 of the cavity 15, a ladle 19 for pouring molten metal into the sleeve 18, a plunger 21 for pushing the molten metal, a holding furnace 22 for storing the molten metal while holding the temperature thereof, a partition wall 23 for partitioning the holding furnace 22 into two chambers, a degassing device 24 inserted in a chamber opposite to the ladle 19 with respect to the partition wall 23, and a gas container 25 for feeding an insert gas such as argon gas to the degassing device 24. Reference numeral 27 designates a mold releasing agent injecting nozzle; 28 is a local portion pressing cylinder; and 29 is a sprue.

Of the above components of the die casting facility, the sleeve 18 and the ladle 19 are each made from a ceramic material having a heat conductivity far smaller than that of iron. In the die casting method of the present invention, the flow rate of molten metal passing through the gate (gate velocity) is smaller than that in the existing die casting method, with the result that the temperature of molten metal is liable to drop. To minimize such a drop of molten metal temperature, the ceramic sleeve and ceramic ladle are adopted in the die casting method of the present invention.

Operation of the above-described die casting facility will now be described with reference to FIG. 1.

1. Preparation of Molten Metal

A molten metal 30 of an aluminum alloy is put in the holding furnace 22 and subjected to a pre-treatment such as degassing.

2. Clamping of Die

The die 14 is clamped by moving the moving platen 13 closer to the stationary platen 12.

3. Scattering of Mold Releasing Agent

The plunger 21 is moved forwardly to block the sprue 29 provided in the sleeve 18. Then, the cavity 15 is evacuated by the vacuum apparatus 16. Simultaneously, the mold releasing agent is injected from the mold releasing agent injecting nozzle 27.

Since the interior of the cavity 15 is under a negative pressure, the mold releasing agent is scattered in the cavity 15 and stuck on the surface of the cavity 15.

4. Pouring of Molten Metal

The plunger 21 is moved backwardly to open the sprue 29. Then, the molten metal fed from the holding furnace 22 by means of the ladle 19 is poured into the sprue 29.

5. Injection

The plunger 21 is moved forwardly to block the sprue 29. Then, the interior of the cavity 15 is evacuated again by the vacuum apparatus 16. Thereafter, the plunger 21 is moved forwardly at a high speed to inject the molten metal into the cavity 15.

6. Take-out of Casting

After completion of solidification, the die 14 is opened and the casting is taken out of the die 14.

The degassing device 24 is adapted to blow argon gas to the molten metal 30 for discharging dissolved gas from the molten metal 30.

The partition wall 23 is a barrier for preventing impurities, which are floated on the surface of the molten metal by blowing of argon gas, from being permeated on the ladle 19 side.

The local portion pressing cylinder 28 is adapted to directly press non-solidified molten metal filled in the cavity 15, thereby increasing a filling pressure.

The operation of these components 24, 23 and 28 may be carried out as desired.

IMPLEMENTATION

Hereinafter, the present invention will be more fully described by way of, but not limited to, the following experimental examples:

Experimental Example 1

Experimental Conditions

Composition of Sample: Aluminum Alloy Die Cast Grade (ADC) 6 in accordance with JIS H 5302 (see Table 1 below)

TABLE 1

Figure 2:
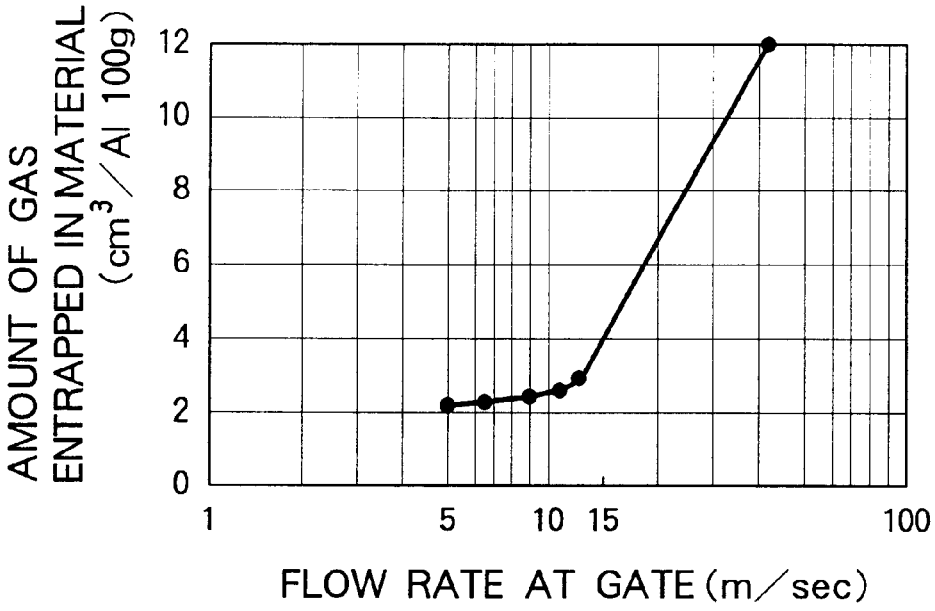
FIG. 2 is a graph showing a relationship between a flow rate of molten metal passing through a gate and the amount of gas entrapped in a material.

| | Chemical Composition | | | | | | | | |
|---|---|---|---|---|---|---|---|---|---|
| Symbol | Cu | Si | Mg | Zn | Fe | Mn | Ni | Sn | Al |
| ADC6 | ≦0.1 | ≦1.0 | 2.5~4.0 | ≦0.1 | 0.8 | 0.4~0.6 | ≦0.1 | ≦0.1 | Balance |

temperature of molten metal: 730° C.

casting machine: ordinary die casting machine flow rate at gate: 5 m/sec to 65 m/sec cross-section of gate: 9.75 $cm^2$ FIG. 2 is a graph showing a flow rate of molten metal passing through the gate and an amount of gas entrapped in the material. More specifically, FIG. 2 shows the result of examination, in the above experiment, the amount of gas entrapped in the material or casting depending on a change in flow rate of molten metal passing through the gate. In the figure, the abscissa designates the flow rate of molten metal passing through the gate, whilst the ordinate designates the amount of gas per 100 g of aluminum.

As is apparent from FIG. 2, when the flow rate of molten metal passing through the gate exceeds 15 m/sec, the amount of gas is significantly increased.

Figure 3:
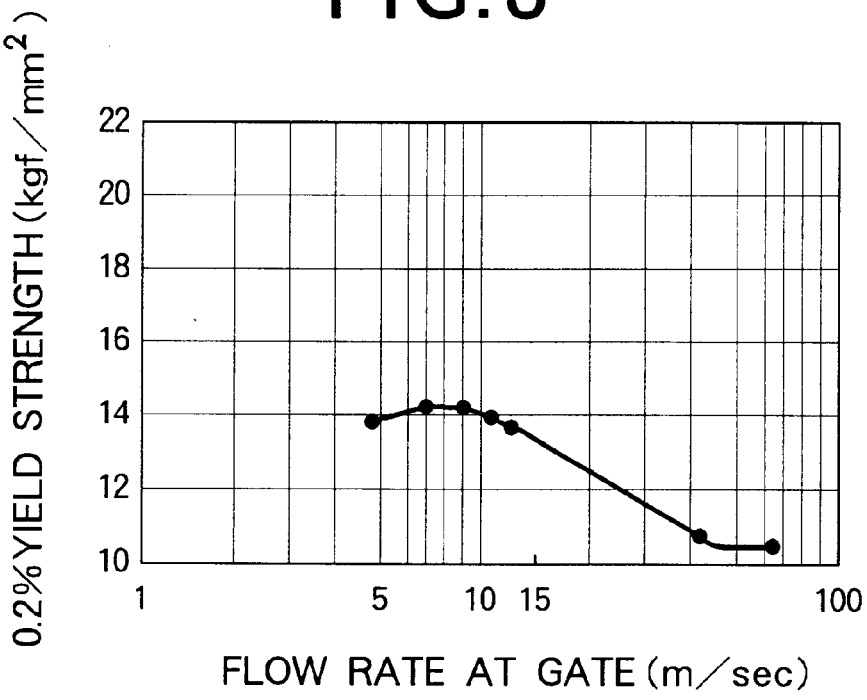
FIG. 3 is a graph showing a relationship between the flow rate of molten metal passing through the gate and the yield strength of a casting.
Figure 4:
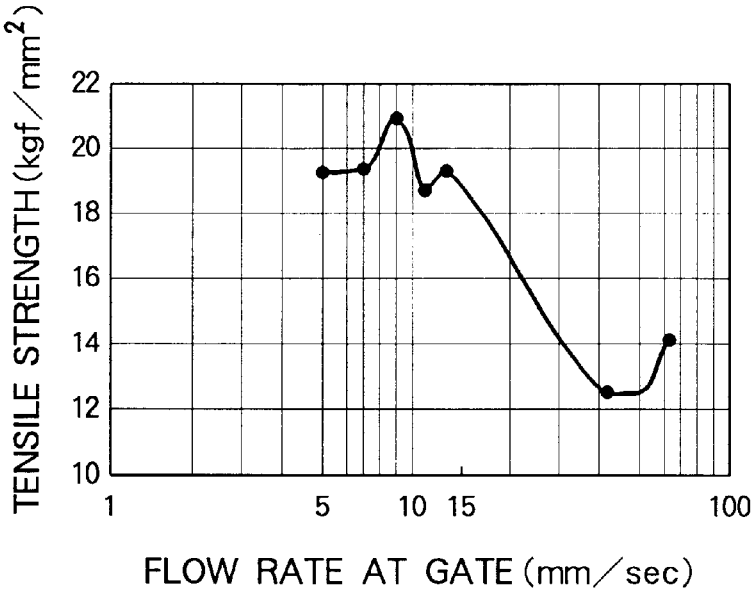
FIG. 4 is a graph showing a relationship between the flow rate of molten metal passing through the gate and the tensile strength of the casting.

FIG. 3 is a graph showing a relationship between a flow rate of molten metal passing through the gate and a yield strength of the casting, whilst FIG. 4 is a graph showing a relationship between a flow rate of molten metal passing through the gate and a tensile strength of the casting.

As described with reference to FIG. 2, when the flow rate of molten metal passing through the gate exceeds 15 m/sec, the amount of gas significantly increases. The gas thus entrapped remains as bubbles in the casting, with the result that as shown in FIGS. 3 and 4, when the flow rate of the molten metal passing through the gate exceeds 15 m/sec, both the yield strength and the tensile strength significantly decrease.

From the above description, it becomes apparent that in die casting an aluminum alloy, the entrapment of gas in molten metal can be significantly improved by specifying the flow rate of the molten metal passing through the gate at a value of 15 m/sec or less. In this way, in the aluminum alloy die casting method according to the present invention, since the entrapment of gas in molten metal is significantly suppressed, the die-cast product obtained according to the method exhibits a finer-grained surface and has less bubbles as compared with a conventional die-cast product. The die-cast product obtained according to the present invention, therefore, is weldable.

While not described using detailed data, if the flow rate of molten metal passing through the gate is less than 5 m/sec, the molten metal is cooled in the course of filling in the cavity, thus resulting in poor runabout (incomplete filing) of the molten metal.

Accordingly, the flow rate of molten metal passing through the gate is preferably specified to be in a range of 5 m/sec to 15 m/sec.

Experimental Example 2

Experimental Conditions

Figure 5:
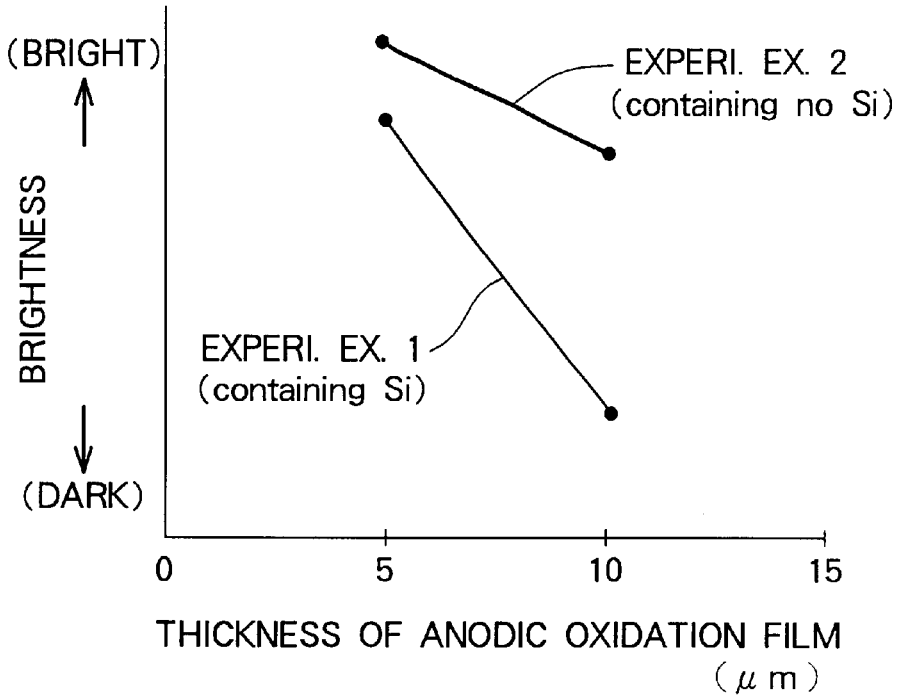
FIG. 5 is a graph showing a relationship between a silicon component and the brightness in color of the casting.

Composition of sample: silicon-less aluminum alloy containing 3.5–4.5% of Mg,1.2–1.8% of Mn, and 0.6–0.9% of Ni, the balance being Al temperature of molten metal: 730° C.

casting machine: ordinary die casting machine flow rate at gate: 7.8–12.8 m/sec cross-section of gate: 8.4 $cm^2$ FIG. 5 is a graph showing a relationship between the brightness in color of the casting and the presence or absence of a Si component of the casting, in which the abscissa designates the thickness of an anodic oxidation film formed on the casting and the ordinate designates the brightness in color of the casting.

For the sample in Experimental Example 1, which is made from the material having the composition of Aluminum Alloy Die Cast Grade 6 (containing 1.0% or less of Si) in accordance with JIS H 5302, the color of the surface of the sample becomes darker with an increase in thickness of the sample.

On the other hand, for the sample in Experimental Example 2, which does not include Si as described, the color of the surface of the sample is brighter than that of the sample in Experimental Example 1.

The reason for this is as follows: namely, in the case where the surface of the die-cast product is subjected to anodic oxidation, Si is bonded to Mg into $Mg_2Si$ which is interposed under the surface of the oxidation film to irregularly reflect light, thereby reducing the brightness in color. Accordingly, a die-cast product of aluminum alloy, whose surface is to be subjected to anodic oxidation, is desired to contain no Si.

The reason why the sample in Experimental Example 2 contains 3.5–4.5% of Mg will be described later.

Figure 6:
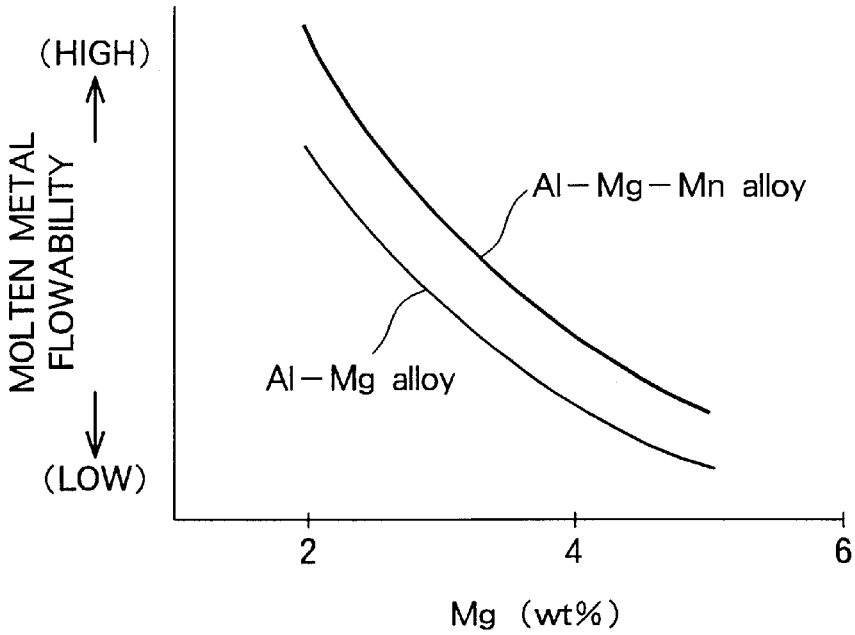
FIG. 6 is a graph showing a relationship between a Mn component and the flowability of molten metal.

FIG. 6 is a graph showing a relationship between a Mn component of an aluminum alloy and the flowability of the molten aluminum alloy, in which the abscissa designates the content of Mg which is an essential element of the aluminum alloy, and the ordinate designates the flowability of the molten aluminum alloy. In FIG. 6, a fine line shows data obtained for an Al—Mg alloy, and a thick line shows data obtained for an Al—Mg—Mn alloy. From this figure, it is apparent that the Al—Mg—Mn alloy is larger in flowability than the Al—Mg alloy.

This means that the increased content of Mg reduces the flowability; however, the reduced flowability can be compensated by the addition of Mn which is an element of suppressing an increase in amount of a solid-phase accompanied by solidification so as to increase the flowability.

If the content of Mn is more than 1.8%, an intermetallic compound, $Al_6Mn$ is crystallized, to reduce the mechanical properties, while if the content of Mn is less than 1.2%, the effect of suppressing the amount of the solid-phase accompanied by solidification is insufficient.

Accordingly, in the present invention, the content of Mn is specified to be in a range of 1.2% to 1.8%.

Ni is an element of forming an eutectic crystal, $Al_3Ni$ to supply a molten component to fine cracks, thereby suppressing propagation of cracking. If the content of Ni is more than 0.9%, the negative effect of Ni is not negligible, while if it is less than 0.6%, the effect of suppressing cracking is insufficient.

Accordingly, in the present invention, the content of Ni is specified to be in a range of 0.6 to 0.9%.

Figure 7:
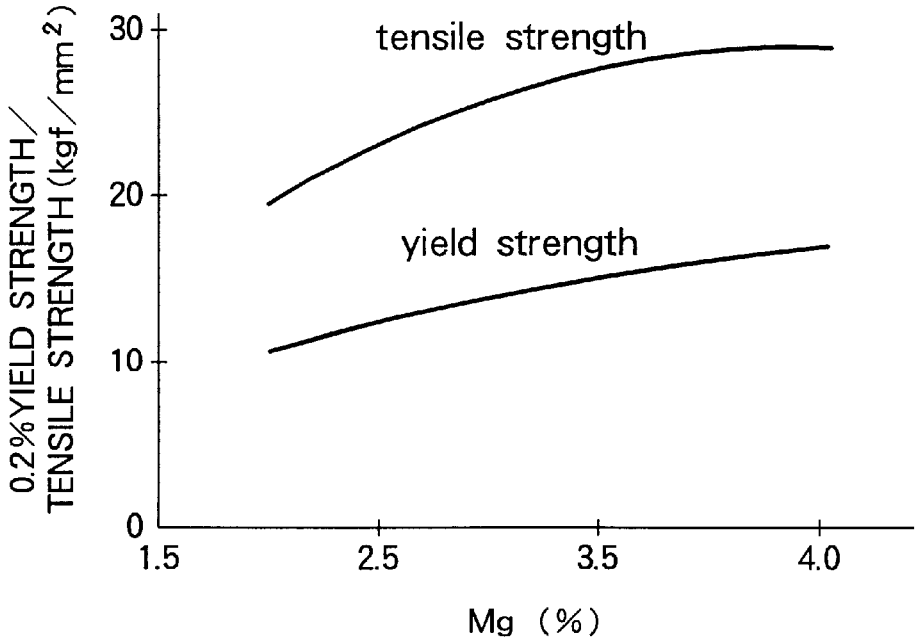
FIG. 7 is a graph showing a relationship between a Mg component and both the yield strength and the tensile strength of the casting.

FIG. 7 is a graph showing a relationship between the content of Mg and both the yield strength and the tensile strength of a casting, in which the abscissa designates the content of Mg and the ordinate designates the 0.2% yield strength and tensile strength.

As is apparent from FIG. 7, both the yield strength and the tensile strength increase with the increase in content of Mg.

Figure 8:
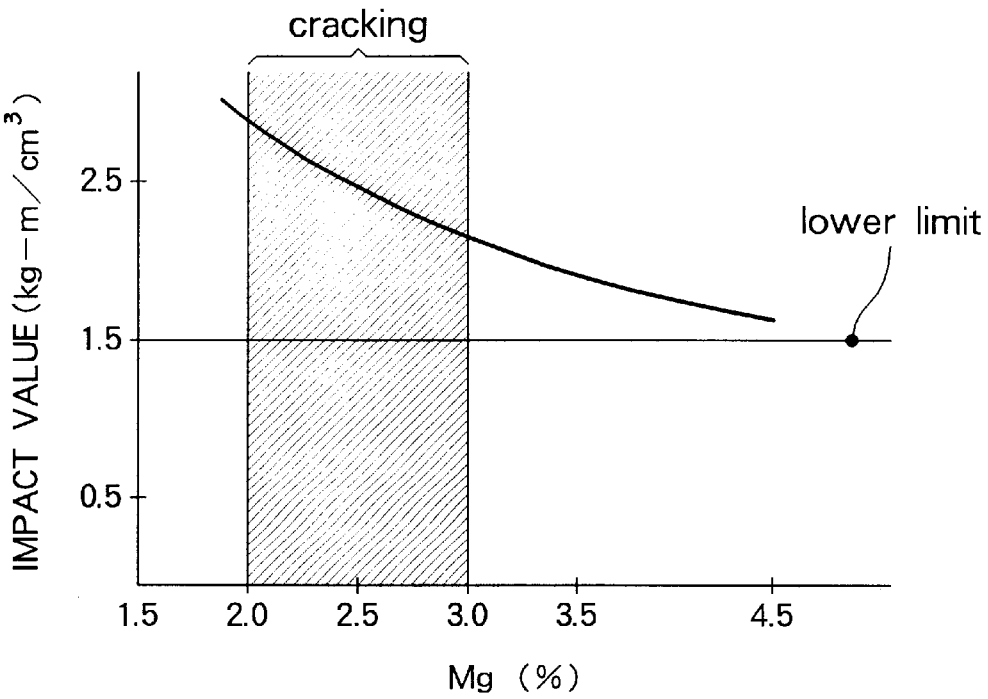
FIG. 8 is a graph showing a relationship between a Mg component and both the impact value and the cracking sensitivity of the casting.

FIG. 8 is a graph showing a relationship between the content of Mg and both the impact value and the cracking sensitivity of a casting, in which the abscissa designates the content of Mg and the ordinate designates an impact value.

As is apparent from FIG. 8, the cracking sensitivity increases when the content of Mg is in a range of 2.0% to 3.0%. To suppress the cracking sensitivity, the content of Mg should be out of the above range of 2.0% to 3.0% by at least 0.5%, that is, should be set at 1.5% or less or 3.5% or more. However, the content of Mg in the range of 1.5% or less is not desirable in terms of the yield strength and tensile strength of the casting.

The impact value becomes smaller with the increase in content of Mg. Assuming that the lower limit of the impact value is 1.5 kg-m/$cm^2$, the content of Mg should be less than 4.5%.

Accordingly, in the present invention, the content of Mg is specified to be in a range of 3.5% to 4.5%.

The function of the mold releasing agent will be discussed below.

Use of a mold releasing agent is effective to smoothly release a casting from a die. The mold releasing agent is required to contain a volatile component such as a high polymer based synthetic oil. The volatile component contained in the mold releasing agent, which has a high stickiness, allows the mold releasing agent to be desirably stuck on the die. The volatile component, however, is thermally decomposed to produce a hydrogen gas.

Figure 9:
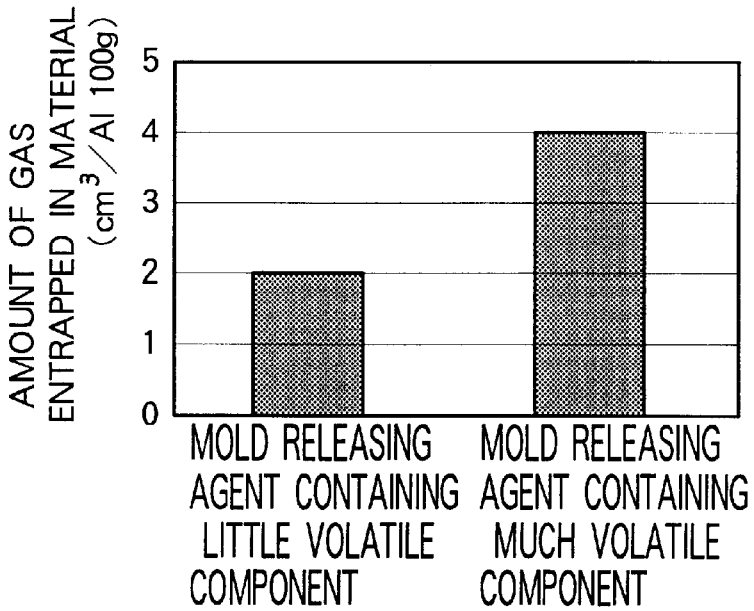
FIG. 9 is a graph showing a relationship between a mold releasing agent and the amount of gas.

FIG. 9 is a graph showing a relationship between a mold releasing agent and the amount of gas entrapped in a casting. As is apparent from this figure, when the mold releasing agent containing a smaller amount of the volatile component is used, the amount of gas is 2 $cm^3$ per 100 g of Al.

On the contrary, when the mold releasing agent containing a larger amount of the volatile component is used, the amount of gas is 4 $cm^3$ per 100 g of Al.

If the volatile component contained in the mold releasing gent is more than 30 wt %, a large amount of gas is produced to hereby exert an adverse effect on the weldability of the casting, while if it is less than 15 wt %, the stickiness of the molding releasing agent is insufficient.

Accordingly, in the aluminum alloy die casting method according to the present invention, the content of the volatile component volatilized at a temperature of 700° C. or more is specified to be in a range of 30 wt % or less, preferably, in a range of 15 wt % to 30 wt %.

Next, a structure will be examined using a part composed of an aluminum alloy casting manufactured according to the present invention, the part being joined to other parts by welding.

Figure 10A:
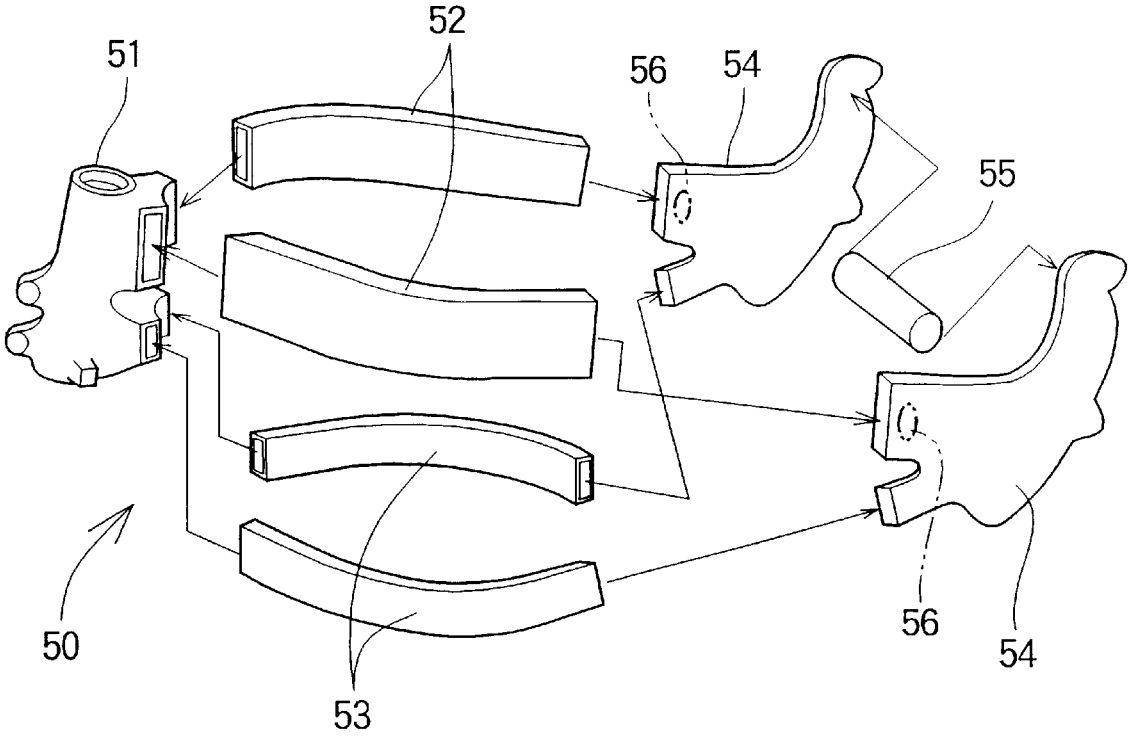
FIG. 10A is an exploded perspective view showing a two-wheeled vehicle employing aluminum alloy castings produced in accordance with the present invention.
Figure 10B:
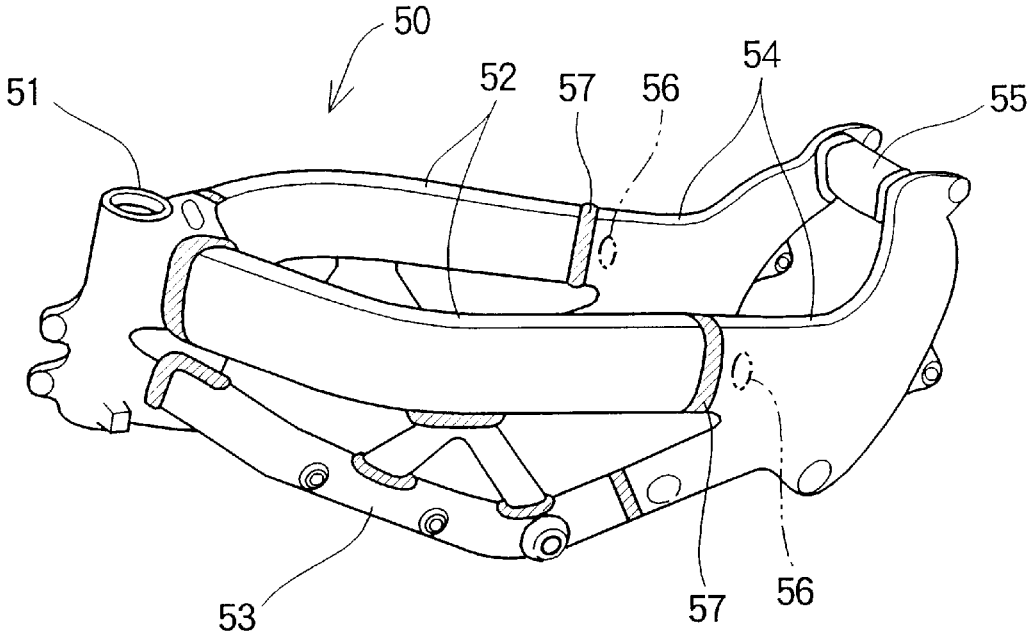
FIG. 10B is a perspective view showing the two-wheeled vehicle of FIG. 10A as assembled.

FIG. 10A is an exploded perspective view showing a two-wheeled vehicle employing aluminum alloy castings produced in accordance with the present invention, whilst FIG. 10B is a perspective view showing the two-wheeled vehicle of FIG. 10A as assembled.

Referring to FIG. 10A, a two-wheeled vehicle body 50, which is made of an aluminum alloy as a whole, has an assembled structure including a head pipe 51 manufactured by, for example, the gravity die casting method; a pair of longitudinal pipes 52 and a pair of longitudinal pipes 53 manufactured by drawing or extrusion; pivot plates 54 manufactured by the die casting method; and a cross pipe 55 manufactured by drawing or extrusion.

In the case of die casting the pivot plate 54, a gate is arranged in a die in such a manner that an end portion (called gate portion) 56 for die casting, to be connected to the longitudinal pipe 52, of the pivot plate 54.

Air is less entrapped and thereby a casting failure is less produced in the gate portion 56 as compared with other portions.

FIG. 10B shows the assembled state of the two-wheeled body 50 in which the pivot plates 54 are butt-welded to the longitudinal pipes 52. In this figure, reference numeral 57 designates a weld bead. Since the portions near the gate portions 56 are less in entrapment of gas and also dense in structure, a blister of gas due to welding heat is not produced, to thereby manufacture a desirable welded structure. In addition, the gate portion 56 may be located at an end portion, on the longitudinal pipe 53 side, of the pivot plate 54 or a contact of the pivot plate 54 with the cross pipe 55. The end portion, on the longitudinal pipe 52 or 53, of the pivot plate 54, and the contact of the pivot plate 54 with the cross pipe 55 are called "portions used for weld connection".

Accordingly, to manufacture a high quality welded structure, the gate portion 56 for die casting may be desirable to be located at the "portion used for weld connection" of a casting, for example, the pivot plate 54.

Obviously, various minor changes and modifications of the present invention are possible in the light of the above teaching. It is therefore to be understood that within the scope of the appended claims the present invention may be practiced otherwise than as specifically described.

What is claimed is:

1. An aluminum alloy die casting method comprising the actions of:

providing a die casting machine having a gate for allowing passage of molten aluminum alloy;

setting a sectional area S ($cm^2$) of said gate to be in a range specified by the following equation:

$$\frac{W}{3272.4\times T^2} \leq S \leq \frac{W}{1090.8\times T^2}$$

where W (g) is a weight of a casting, and T (cm) is a typical thickness of the casting;

setting a flow rate of the molten aluminum alloy at the gate to be in a range of 5 m/sec to 15 m/sec; and press-injecting the molten aluminum alloy into a cavity of a die.

2. An aluminum alloy die casting method according to claim 1, further comprising the action of coating said die with a mold releasing agent which contains an inorganic component and graphite as main components and a volatile component in a range of 15 wt % to 30 wt % as a sub-component, but does not contain moisture.

3. An aluminum alloy die casting method according to claim 1, further comprising the action of arranging said gate to be positioned at that portion of the casting which is used for weld connection to other structural parts.

* * * * *